US011303039B2

(12) United States Patent
Rogers

(10) Patent No.: US 11,303,039 B2
(45) Date of Patent: Apr. 12, 2022

(54) ELECTROMAGNETIC RADIATORS WITH GROUND PLANES HAVING DISCONTINUITIES

(71) Applicant: The Boeing Company, Chicago, IL (US)

(72) Inventor: John E. Rogers, Owens Cross Roads, AL (US)

(73) Assignee: The Boeing Company, Chicago, IL (US)

( * ) Notice: Subject to any disclaimer, the term of this patent is extended or adjusted under 35 U.S.C. 154(b) by 23 days.

(21) Appl. No.: 16/885,644

(22) Filed: May 28, 2020

(65) Prior Publication Data

US 2021/0376488 A1 Dec. 2, 2021

(51) Int. Cl.

| | |
|---|---|
| ***H01Q 21/06*** | (2006.01) |
| ***H01Q 1/28*** | (2006.01) |
| ***H01Q 21/00*** | (2006.01) |
| ***H01Q 1/48*** | (2006.01) |

(52) U.S. Cl.
CPC ..... *H01Q 21/065* (2013.01); *H01Q 1/287* (2013.01); *H01Q 1/48* (2013.01); *H01Q 21/0075* (2013.01)

(58) Field of Classification Search
CPC .... H01Q 21/0075; H01Q 21/065; H01Q 1/48; H01Q 1/287
See application file for complete search history.

(56) References Cited

U.S. PATENT DOCUMENTS

2019/0131699 A1* 5/2019 Shamblin ..... H01Q 9/0421

FOREIGN PATENT DOCUMENTS

JP H06112726 A * 4/1994 ..... H01Q 13/08

OTHER PUBLICATIONS

Gauthier et al., "A 94-GHz Aperture-Coupled Micromachined Microstrip Antenna," IEEE Transactions on Antennas and Propagation, vol. 47, No. 12, Dec. 1999, 6 pages.
Iwasaki, Hisao, "A Circularly Polarized Small-Size Microstrip Antenna with a Cross Slot," IEEE Transactions on Antennas and Propagation, vol. 44, No. 10, Oct. 1996, 3 pages.
Arya et al., "Defected Ground Structure in the Perspective of Microstrip Antennas: A Review," Frequenz, vol. 64, Issue 5-6, Jun. 1, 2010, 6 pages.

(Continued)

*Primary Examiner* — Hoang V Nguyen
(74) *Attorney, Agent, or Firm* — Hanley, Flight & Zimmerman, LLC

(57) ABSTRACT

An electromagnetic radiator with ground plane having discontinuities is disclosed. A disclosed example antenna includes an antenna element, including a first conductive material adjacent to a first dielectric material, to transmit a signal. The disclosed example antenna further includes a microstrip feed network, including a second conductive material adjacent to a second dielectric material, to transmit power to the antenna element, the antenna element proximity coupled to the microstrip feed network. The disclosed example antenna further includes a ground plane, including a third conductive material adjacent to a third dielectric material, to provide a signal return path, the ground plane including gaps regularly spaced in the third conductive material.

24 Claims, 10 Drawing Sheets

(56) References Cited

OTHER PUBLICATIONS

Pozar, D.M. & Kaufman, B., "Increasing the Bandwidth of a Microstrip Antenna by Proximity Coupling," Electronics Letters, vol. 23, No. 8, Apr. 9, 1987, 2 pages.
Papapolymerou et al., "Micromachined Patch Antennas," IEEE Transactions on Antennas and Propagation, vol. 46, No. 2, Feb. 1998, 9 pages.
Pozar, D.M., "Microstrip Antenna Aperture-Coupled to a Microstripline," Electronics Letters, vol. 21, No. 2, Jan. 17, 1985, 2 pages.
Guha et al., "Microstrip Patch Antenna with Defected Ground Structure for Cross Polarization Suppression," IEEE Antennas and Wireless Propagation Letters, vol. 4, 2005,4 pages.
Cook et al., "Multilayer Inkjet Printing of Millimeter-Wave Proximity-Fed Patch Arrays on Flexible Substrates," IEEE Antennas and Wireless Propagation Letters, vol. 12, 2013, 4 pages.
Sorkherizi et al., "Planar High-efficiency Antenna Array Using New Printed Ridge Gap Waveguide Technology," IEEE Transactions on Antennas and Propagation, vol. 65, No. 7, Jul. 2017, 5 pages.

* cited by examiner

ELECTROMAGNETIC RADIATORS WITH GROUND PLANES HAVING DISCONTINUITIES

FIELD OF THE DISCLOSURE

This disclosure relates generally to electromagnetic radiators and, more particularly, to electromagnetic radiators with ground planes having discontinuities.

BACKGROUND

In recent years, unmanned aerial vehicles (UAVs) or drones have been used to fly significant distances to transport payloads (e.g., packages, supplies, equipment, etc.) or gather information. UAVs or drones use electromagnetic radiators (e.g., antennas) for communications with other aerial vehicles and/or ground structures.

SUMMARY

An example antenna includes an antenna element, including a first conductive material adjacent to a first dielectric material, to transmit a signal, a microstrip feed network, including a second conductive material adjacent to a second dielectric material, to transmit power to the antenna element, and a ground plane, including a third conductive material adjacent to a third dielectric material, to provide a signal return path, where the ground plane includes gaps regularly spaced in the third conductive material.

An example apparatus to form an antenna includes a first layer to transit a signal, where the first layer includes a first conductive material on a surface of a first dielectric, a second layer to transmit power to the first layer, where the second layer includes a second conductive material on a surface of a second dielectric material, and a third layer to provide a signal return path, where the third layer includes a third conductive material on a surface of a third dielectric material, and where the third layer includes regularly-spaced gaps in the third conductive material on the surface of the third dielectric material.

An example method of forming an antenna includes disposing a first conductive element on a surface of a first dielectric material to form a first layer, disposing a second conductive element on a surface of a second dielectric material to form a second layer, disposing a third conductive element on a surface of a third dielectric material to form a third layer, the third conductive element being a ground plane, disposing regularly-spaced gaps in the third conductive element, and laminating the first layer, the second layer, the third layer, a fourth layer of a fourth dielectric material, and a fifth layer of a fifth dielectric material to form the antenna, wherein the fourth layer is between the first layer and the second layer, and wherein the fifth layer is between the second layer and the third layer.

Figure 1:
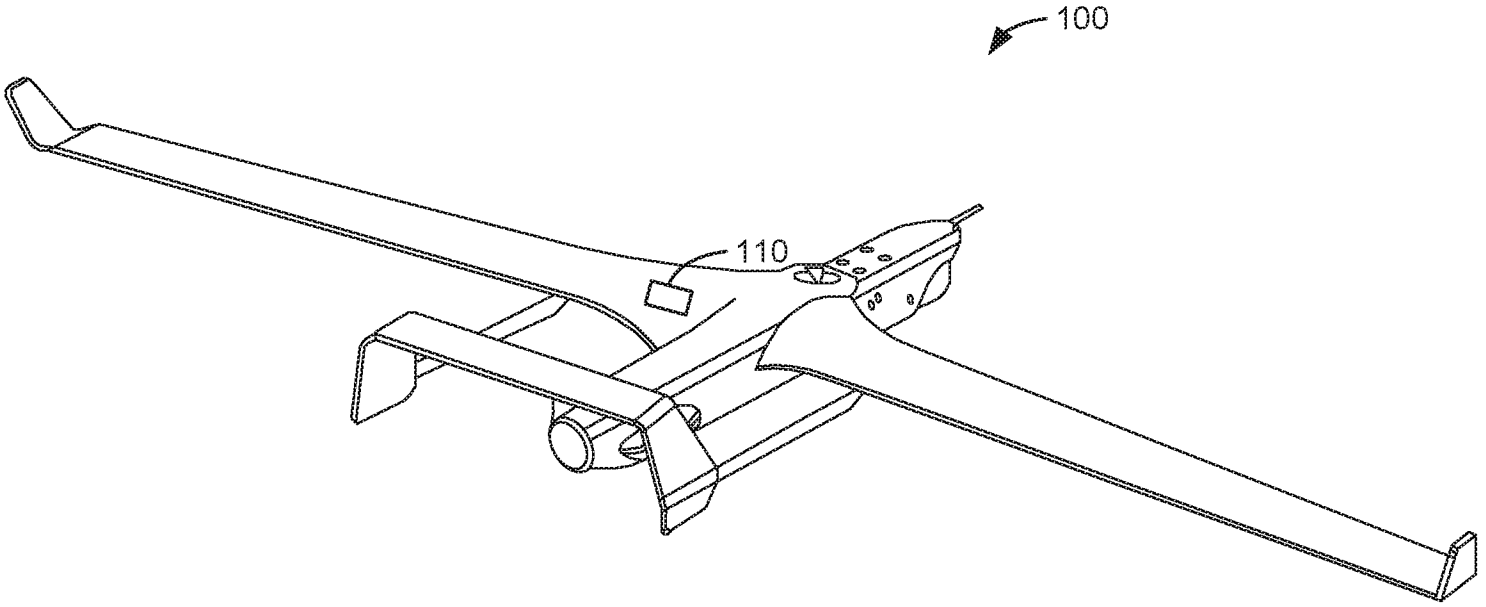
FIG. 1 is a schematic illustration of an example unmanned aerial vehicle (UAV) in which examples disclosed herein can be implemented.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Stating that any part is in "contact" with another part means that there is no intermediate part between the two parts. Although the figures show layers and regions with clean lines and boundaries, some or all of these lines and/or boundaries may be idealized. In reality, the boundaries and/or lines may be unobservable, blended, and/or irregular.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

Throughout the years, antennas on aircrafts have been essential for communication tasks and maintenance. For example, antennas provide air-to-air communication between different aircrafts as well as air-to-ground communications between an aircraft and a ground station. Antennas also help provide communications for the aircraft on a factory floor using the Internet of Things (IoT). For example, an antenna on an aircraft on a factory floor may help with electromagnetic energy (EME) monitoring and/or other diagnostic testing of the aircraft. Furthermore, antennas have also provided communications within the aircraft with the IoT. For example, an antenna on an aircraft can help with structural health monitoring on the aircraft.

In recent years, there has been a need in the aerospace industry for antennas capable of being placed on conformal surfaces (e.g., surfaces that easily fit together with the mounting surface of the antenna) such as, for example, aircraft wings, and non-conformal surfaces (e.g., surfaces that do not fit well together with the mounting surface of the antenna) such as, for example the aircraft fuselage. Small aircrafts such as unmanned aerial vehicles (UAVs) have surfaces with small radii of curvature. Such vehicles need lightweight antennas with low aerodynamic drag (for improved efficiency) and low visibility (e.g., radar cross-section). Also, aircraft surfaces are typically composed of carbon fiber or other metallic materials, which have been shown to change the electrical behavior of antennas. To overcome these challenges, planar microstrip antennas have been developed to provide low aerodynamic drag and low visibility while not interacting with the exterior materials of the aircraft. However, planar microstrip antennas have limited gain and bandwidth due to their size.

Examples disclosed herein include an electromagnetic radiator (e.g., antenna) that include a proximity-coupled antenna element, an embedded microstrip feed network, a ground plane, and one or more defects within the ground plane. As used herein, a "defect" in the ground plane corresponds to one or more discontinuities such as openings, gaps or slots that interrupt an otherwise continuous structure of the ground plane of the antenna. Examples disclosed herein include the ground plane defects to compel the current to circulate in such a way as to lower the cross-polarization of the antenna.

Examples disclosed herein include an embedded RF microstrip feed network electrically coupled to a ground plane for efficient signal propagation. Examples disclosed herein include a ground plane to minimize any change in the electrical behavior of the antenna due to environmental surfaces (e.g., conductive surfaces) to which the antenna is attached/mounted. Examples disclosed herein have an antenna element electrically coupled to the microstrip feed network. Examples disclosed herein have reduced size and weight in comparison to existing surface emitting antennas (e.g., horn antennas), which helps to reduce drag and visibility. Examples disclosed herein can be easily manufactured due to the need for no electrical vias in the antenna. Examples disclosed herein can be manufactured using subtractive (e.g., laser etching, milling, wet etching) or additive (e.g., printing, film deposition) methods.

FIG. 1 is a schematic illustration of an example unmanned aerial vehicle (UAV) 100 in which examples disclosed herein can be implemented. The example UAV 100 includes an example antenna 110. In the illustrated example of FIG. 1, the antenna 110 includes proximity coupled antenna elements, an embedded microstrip feed network, and a ground plane with one or more defects such as discontinuities within the ground plane. In the illustrated example of FIG. 1, the antenna elements are proximity coupled to the embedded microstrip feed network. In the illustrated example of FIG. 1, the antenna 110 is capable of being conformed to surfaces of the UAV. In the illustrated example of FIG. 1, the antenna 110 is located on the left wing of the UAV 100. However, the antenna 110 may additionally and/or alternatively be located on any other surface of the UAV 100. Although the example antenna 110 is implemented on the UAV 100 in examples disclosed herein, the antenna 110 can be implemented on any manned or unmanned aircraft. The antenna 110 is described in further detail below in connection with FIGS. 2A, 2B, 3, and 4.

Figure 2A:
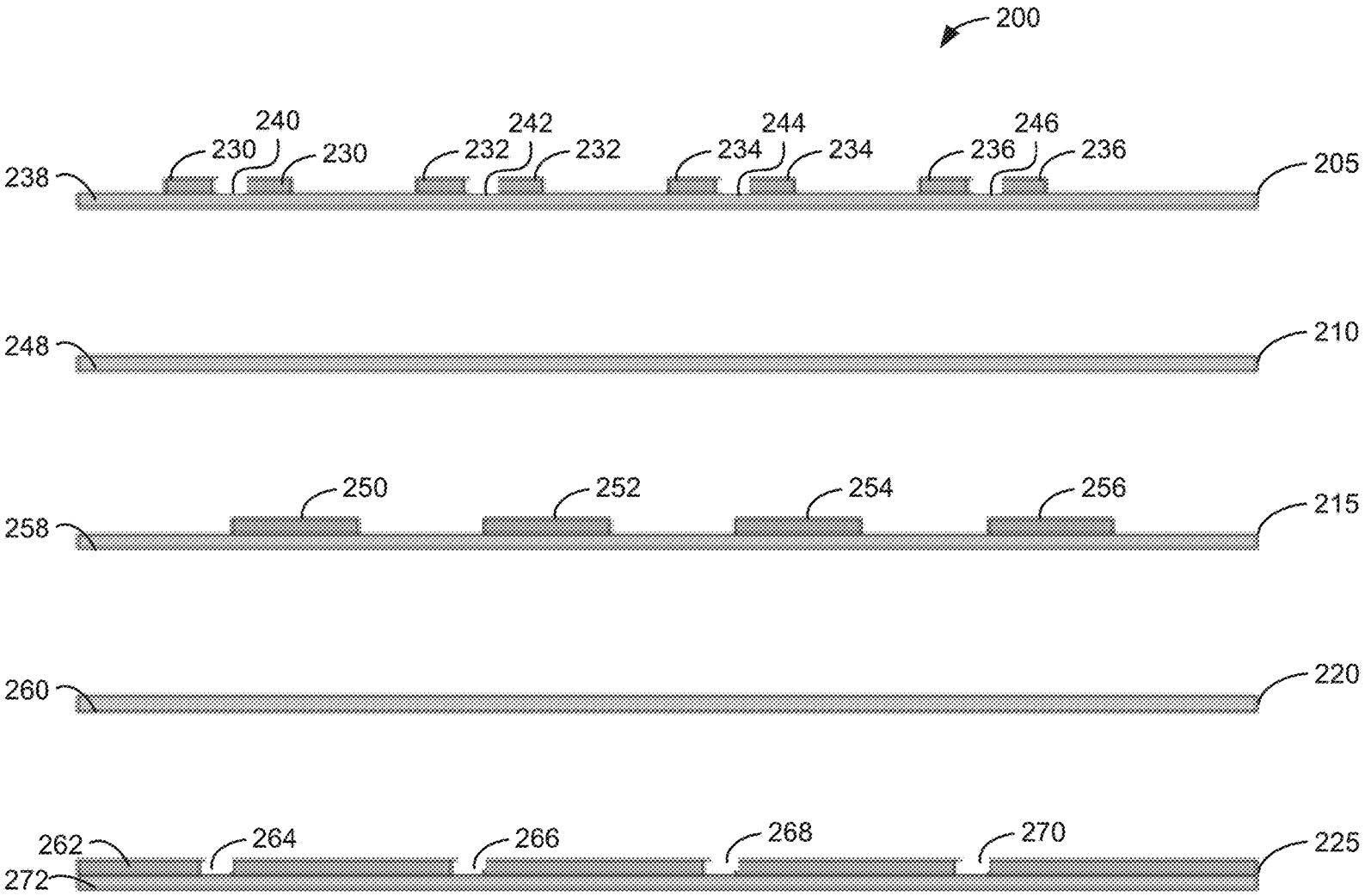
FIG. 2A depicts example layers of an antenna in accordance with the example disclosed herein.

FIG. 2A depicts example layers of an antenna 200 in accordance with the examples disclosed herein. The antenna 200 of FIG. 2A may be used to implement the example antenna 110 of FIG. 1. The layers of FIG. 2A include an example first layer 205, an example second layer 210, an example third layer 215, an example fourth layer 220, and an example fifth layer 225. In the illustrated example of FIG. 2A, the first layer 205 includes example antenna elements 230, 232, 234, 236, an example dielectric layer 238, and example slot gaps 240, 242, 244, 246. In the illustrated example of FIG. 2A, the second layer 210 includes an example dielectric layer 248. The third layer 215 includes example microstrip feeds 250, 252, 254, 256 and an example dielectric layer 258. The fourth layer 220 includes an example dielectric layer 260. In the illustrated example of FIG. 2A, the fifth layer 225 includes an example ground plane 262 having discontinuities 264, 266, 268, 270, and an example dielectric layer 272.

In the illustrated example of FIG. 2A, the first layer 205 transmits a signal for the example antenna 200. The first layer 205 includes the example antenna elements 230, 232, 234, 236, which include conductive material such as, for example, copper. However, other conductive materials may additionally and or alternatively be used. In the illustrated example and orientation of FIG. 2A, the example conductive material of the antenna elements 230, 232, 234, 236 is coupled to the upper surface of the dielectric layer 238. In the illustrated example of FIG. 2A, the example antenna elements 230, 232, 234, 236 have inclusive slot gaps 240, 242, 244, 246. In the illustrated example of FIG. 2A, the slot gaps 240, 242, 244, 246 are representative of the slots or openings in the antenna elements 230, 232, 234, 236, which help to radiate the signal from the example antenna 200.

In the illustrated example of FIG. 2A, the second layer 210 provides space between and further electrically insulates the example antenna elements 230, 232, 234, 236 of the first layer 205 and the microstrip feeds 250, 252, 254, 256 of the third layer 215. The second layer 210 provides a separation distance between the antenna elements 230, 232, 234, 236 and the microstrip feeds 250, 252, 254, 256 to enable the antenna 200 to efficiently radiate at certain frequencies to suit the needs of a given application. In some examples, radiating at a higher frequency requires a smaller separation distance between the antenna elements 230, 232, 234, 236 and the microstrip feeds 250, 252, 254, 256. Conversely, radiating at a lower frequency requires a larger separation distance between the antenna elements 230, 232, 234, 236 and the microstrip feeds 250, 252, 254, 256. Thus, the second layer 210 enables the separation distance to be adjusted for the example antenna 200 to suit the needs of a particular application.

In the illustrated example of FIG. 2A, the third layer 215 transmits a power signal to the antenna elements 230, 232, 234, 236 of the first layer 205. The third layer 215 includes the microstrip feeds 250, 252, 254, 256. The microstrip feeds 250, 252, 254, 256 include conductive material such as, for example, copper. However, other conductive materials may additionally and or alternatively be used. In the illustrated example and orientation of FIG. 2A, the example conductive material of the microstrip feeds 250, 252, 254, 256 is coupled to the upper surface of the example dielectric layer 258.

In the illustrated example of FIG. 2A, the fourth layer 220 provides space between the microstrip feeds 250, 252, 254, 256 of the third layer 215 and the ground plane 262 of the fifth layer 225. The fourth layer 220 includes the dielectric layer 260. Similar to the second layer 210, the fourth layer 220 enables the separation distance between the microstrip feeds 250, 252, 254, 256 and the ground plane 262 to be adjusted to suit the needs of a given application.

In the illustrated example of FIG. 2A, the fifth layer 225 includes the ground plane 262 to minimize any change in the electrical behavior of example antenna 200 that may be caused by any environmental surfaces to which the antenna is mounted and/or which contact the antenna 200. The ground plane 262 provides a signal return path for the antenna 200. The ground plane 262 includes conductive material such as, for example, copper. However, other conductive materials may additionally and or alternatively be used. In the illustrated example of FIG. 2A, the conductive material of the ground plane 262 is coupled to the upper surface of the example dielectric layer 272. In the illustrated example of FIG. 2A, the ground plane 262 includes the discontinuities 264, 266, 268, 270 (e.g., gaps, openings, slots, etc.) to compel the current from the antenna elements 230, 232, 234, 236 to circulate in such a way as to lower the cross-polarization of the antenna. In the illustrated example of FIG. 2A, the discontinuities 264, 266, 268, 270 are representative of regularly-spaced gaps in the ground plane 262. However, other spacings (e.g., irregular) may be used instead.

Figure 2B:
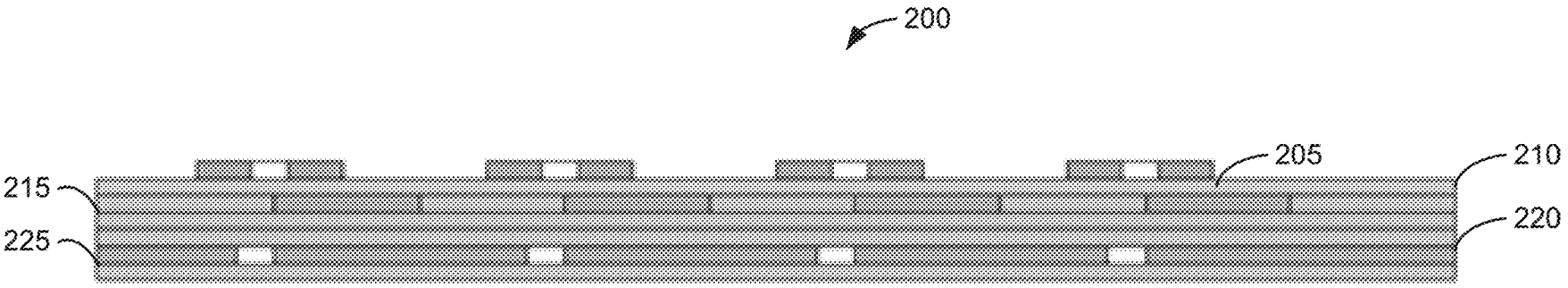
FIGS. 2B and 2C depict the example layers of FIG. 2A in assembled states.

FIG. 2B depicts the example layers of FIG. 2A in an assembled state. The layers of FIG. 2B include the first layer 205, the second layer 210, the third layer 215, the fourth layer 220, and the fifth layer 225. In the illustrated example of FIG. 2B, the first layer 205 is coupled to the surface of the second layer 210 that faces away from the surface to which the antenna 200 is mounted (i.e., the upper surface of the second layer 210 in the orientation of FIG. 2B). Similarly, the second layer 210 is coupled to the surface of the third layer 215 that faces away from the surface to which the antenna 200 is mounted, the third layer 215 is coupled to the surface of the fourth layer 220 that faces away from the surface to which the antenna 200 is mounted, and the fourth layer 220 is coupled to the surface of the fifth layer 225 that faces away from the surface to which the antenna 200 is mounted. In the illustrated example of FIG. 2B, the first layer 205, the second layer 210, the third layer 215, the fourth layer 220, and the fifth layer 225 are coupled using adhesive material. For example, each of the first layer 205, the second layer 210, the third layer 215, the fourth layer 220, and the fifth layer 225 includes an adhesive material on the respective surfaces of the dielectric layers 238, 248, 258, 260, 272 that face the surface to which the antenna 200 is mounted.

Figure 2C:
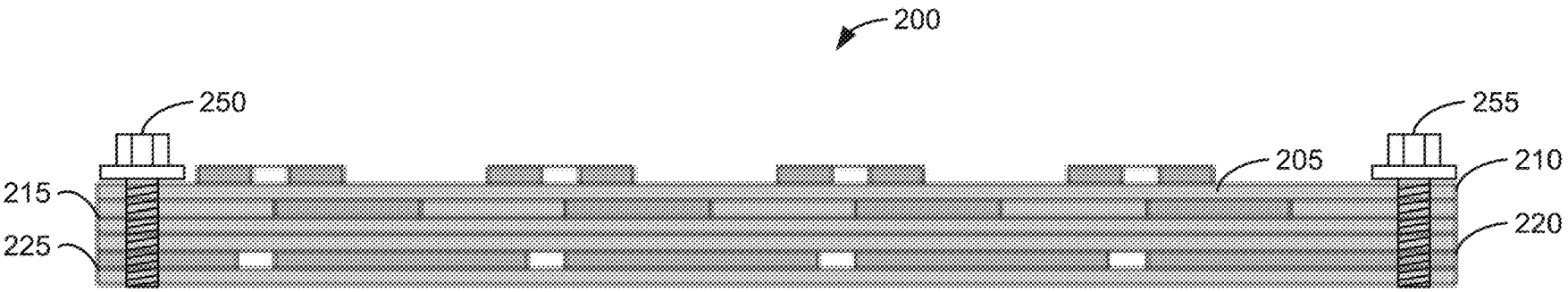

FIG. 2C depicts the example layers of FIG. 2A in an alternative assembled state. The layers of FIG. 2C include the first layer 205, the second layer 210, the third layer 215, the fourth layer 220, and the fifth layer 225. In the illustrated example of FIG. 2C, the first layer 205 is coupled to the surface of the second layer 210 that faces away from the surface to which the antenna 200 is mounted (i.e., the upper surface of the second layer 210 in the orientation of FIG. 2B). Similarly, the second layer 210 is coupled to the surface of the third layer 215 that faces away from the surface to which the antenna 200 is mounted, the third layer 215 is coupled to the surface of the fourth layer 220 that faces away from the surface to which the antenna 200 is mounted, and the fourth layer 220 is coupled to the surface of the fifth layer 225 that faces away from the surface to which the antenna 200 is mounted. In the illustrated example of FIG. 2C, the first layer 205, the second layer 210, the third layer 215, the fourth layer 220, and the fifth layer 225 are coupled by screwing the layers together using example mechanical fasteners 250, 255. For example, the first layer 205, the second layer 210, the third layer 215, the fourth layer 220, and the fifth layer 225 are oriented as described previously, and the mechanical fasteners 250, 255 are inserted through the dielectric layers 238, 248, 258, 260, 272 to join the layers of the antenna 200. In such examples, the mechanical fasteners are electrically conductive. In such examples, the mechanical fasteners are placed in positions along the antenna 200 to avoid contacting and electrically shorting the antenna elements 230, 232, 234, 236. In such examples, the mechanical fasteners electrically connect (e.g., short) the ground plane 262 to an environmental surface. In some examples, the mechanical fasteners 250, 255 are screws, bolts, rivets, etc.

Figure 3:
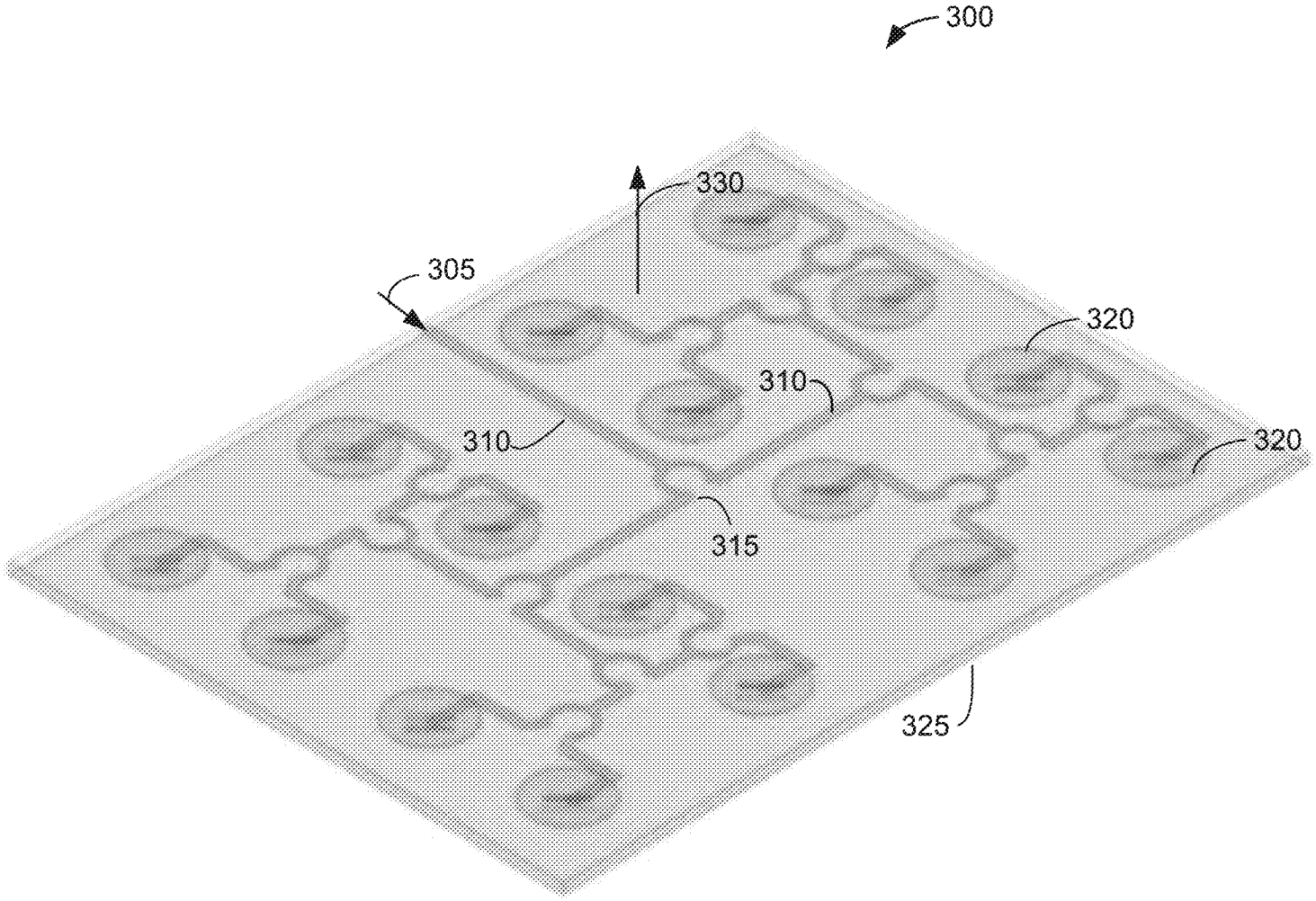
FIG. 3 depicts an example antenna in accordance with examples disclosed herein.

FIG. 3 depicts an example antenna 300 in accordance with examples disclosed herein. The antenna 300 includes an example power input 305, example microstrip feeds 310, an example power divider 315, example antenna elements 320, an example ground plane 325, and an example power output 330. The example of FIG. 3 illustrates a topology that may be used to implement the example antenna 110 of FIG. 1 and/or the example antenna of FIGS. 2A and 2B. However, any other topology may be used instead to suit the needs of a given application.

In the illustrated example of FIG. 3, the microstrip feeds 310 receive power from the power input 305 and transmit the power to the antenna elements 320. In the illustrated example of FIG. 3, the microstrip feeds 310 include conductive material such as, for example, copper, and a dielectric layer (e.g., similar to the dielectric layer 258 of FIG. 2A). In the illustrated example of FIG. 3, antenna 300 illustrates several microstrip feeds in addition to the referenced microstrip feeds 310 that are a part of the microstrip feed network. The antenna 300 is not limited to the number and arrangement of microstrip feeds illustrated in the microstrip feed network of FIG. 3. In some examples, the microstrip feeds 310 are the middle layer of the antenna 300 as shown in the example of FIGS. 2A and 2B. In some examples, the microstrip feeds 310 are electrically coupled below the antenna elements 320 and electrically coupled above the ground plane 325. In some examples, the microstrip feeds 310 are electrically coupled to the ground plane 325.

In the illustrated example of FIG. 3, the power divider 315 helps transfer the power from the power input 305 to the microstrip feed network of the antenna 300. The power divider 315 distributes the power form the power input 305 throughout the microstrip feed network. For example, the power divider 315 collects the power from the microstrip feed 310 and distributes it to two branches of microstrip feeds. In the illustrated example of FIG. 3, antenna 300 illustrates several power dividers in addition to the referenced power divider 315. The antenna 300 is not limited to the number of power dividers illustrated and, thus, can include a plurality of power dividers with similar features to the power divider 315.

The example antenna elements 320 transmit a signal with a specific frequency away from the antenna 300 at the power output 330. The antenna elements 320 receive power from the microstrip feed network including the microstrip feeds 310. In the illustrated example of FIG. 3, the antenna elements 320 include conductive material such as, for example, copper, and a dielectric layer (e.g., similar to the dielectric layer 238 of FIG. 2A). In the illustrated example of FIG. 3, the conductive material of the antenna elements 320 conducts the power output signal 330. In the illustrated example of FIG. 3, antenna 300 illustrates several antenna elements in addition to the antenna element 320 and, thus, the antenna 300 is not limited to the number of antenna elements 320 illustrated in the example of FIG. 3. In some examples, the antenna elements 320 are disposed on the outer surface of the antenna 300 that faces away from the surface to which the antenna 300 is mounted. In some examples, the antenna elements 320 are proximity coupled to the microstrip feeds 310. In some examples, the antenna elements 320 are electrically coupled above the microstrip feeds 310. In some examples, the layer for the antenna elements 320 is coupled to a spacer layer (e.g., similar to the dielectric layer 248 of FIG. 2A) that is between the respective layers for the antenna elements 320 and the microstrip feeds 310.

In the illustrated example of FIG. 3, the example ground plane 325 minimizes any change in the electrical behavior of antenna 300 that may be caused by any environmental surfaces (e.g., metallic or other electrically conductive surfaces) to which the antenna 300 is mounted or otherwise proximate. The example ground plane 325 provides a signal return path for the example antenna 300. In the illustrated example of FIG. 3, the ground plane 325 includes conductive material such as, for example, copper, and a dielectric layer (e.g., similar to the dielectric layer 272 of FIG. 2A). In the illustrated example of FIG. 3, the conductive material of the ground plane 325 reduces any electromagnetic interaction between the antenna 300 and the external environmental surfaces. In some examples, the ground plane 325 is the outer layer on the bottom surface of the antenna 300 (e.g., the surface of the antenna 300 that faces the surface to which the antenna 300 is mounted). In some examples, the ground plane 325 is electrically coupled to the microstrip feed 310. In some examples, the surface of the layer of the ground plane 325 that faces away from the surface to which the antenna 300 is mounted is coupled to a spacer layer (e.g., similar to the dielectric layer 260 of FIG. 2A) that is between the respective layers for the ground plane 325 and the microstrip feeds 310.

Figure 4:
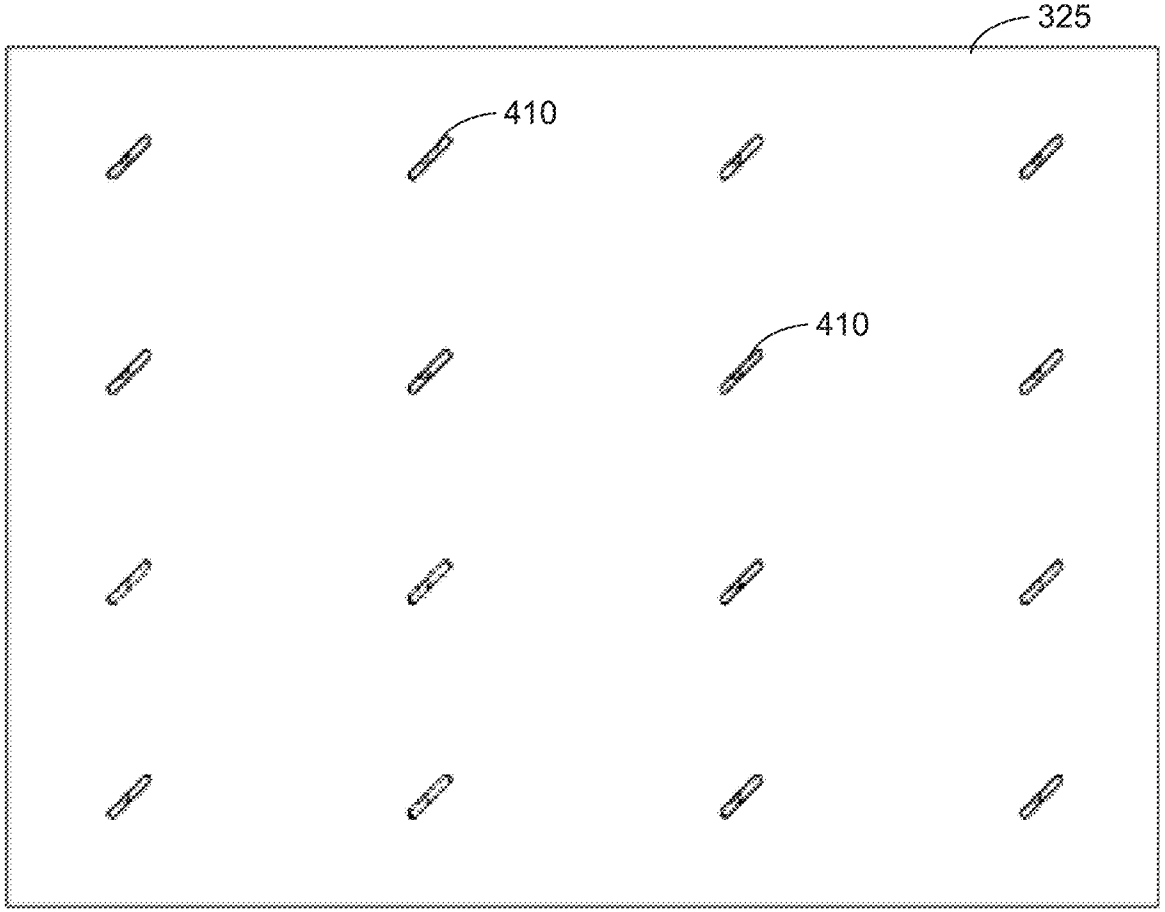
FIG. 4 depicts an example ground plane of the example antenna of FIG. 3.

FIG. 4 depicts a plane view of the example ground plane 325 of the example antenna 300 of FIG. 3. The ground plane 325 includes example discontinuities 410 (e.g., gaps, openings, slots, etc.) provide controlled defects in the ground plane 325 that optimize the performance of the example antenna 300 of FIG. 3. In the illustrated example of FIG. 4, attributes of the discontinuities 410 (e.g., geometry or shape and dimensions) are determined to maximize signal propagation at the desired operating frequency for the antenna 300 of the illustrated example of FIG. 3. In the illustrated example of FIG. 4, the discontinuities 410 are gaps or holes in the conductive material of the ground plane. While the illustrated example of FIG. 4 shows a certain number of regularly spaced discontinuities 410, any number and arrangement of discontinuities can be used instead to suit the needs of a given application.

Figure 5A:
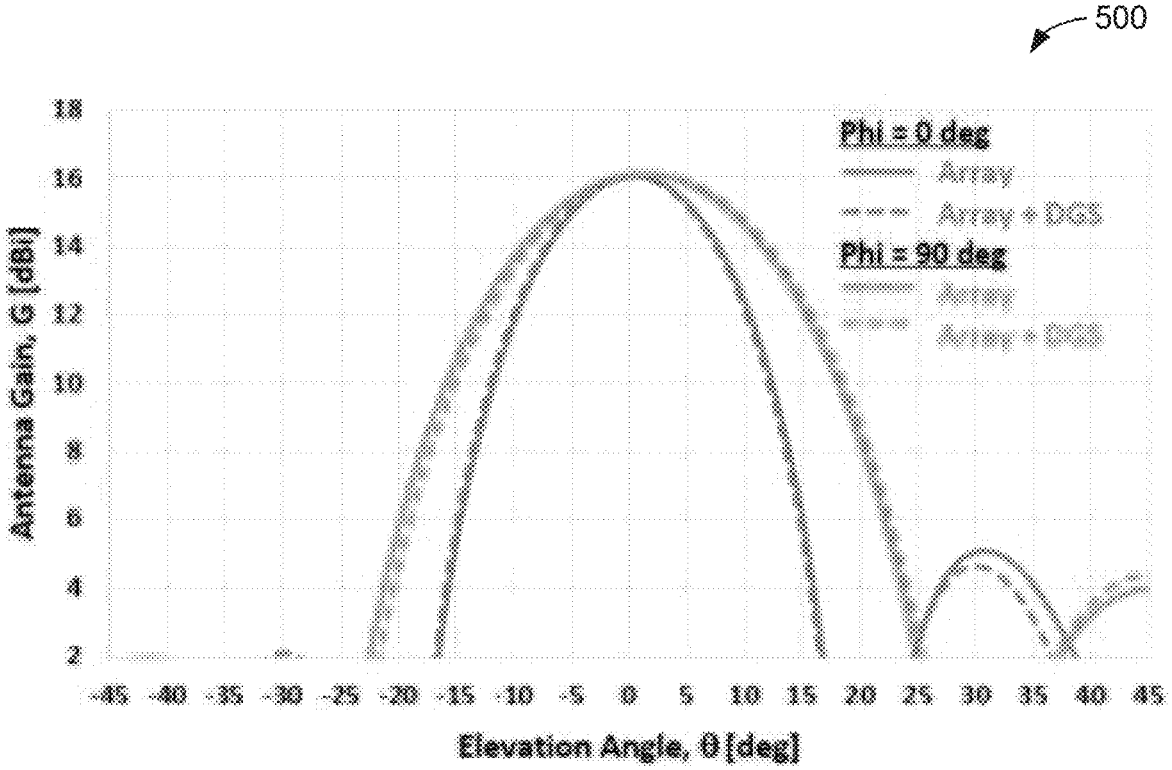
FIGS. 5A, 5B, and 5C depict example results of the example antenna of FIG. 3.
Figure 5B:
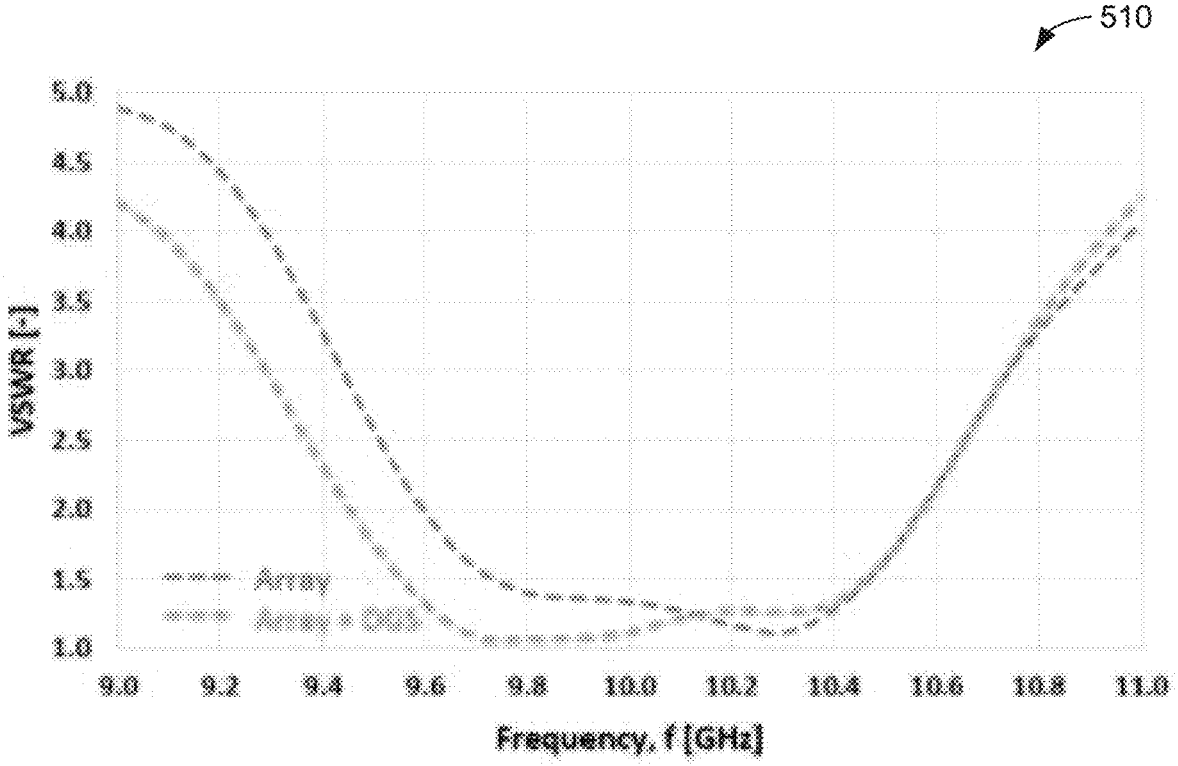
Figure 5C:
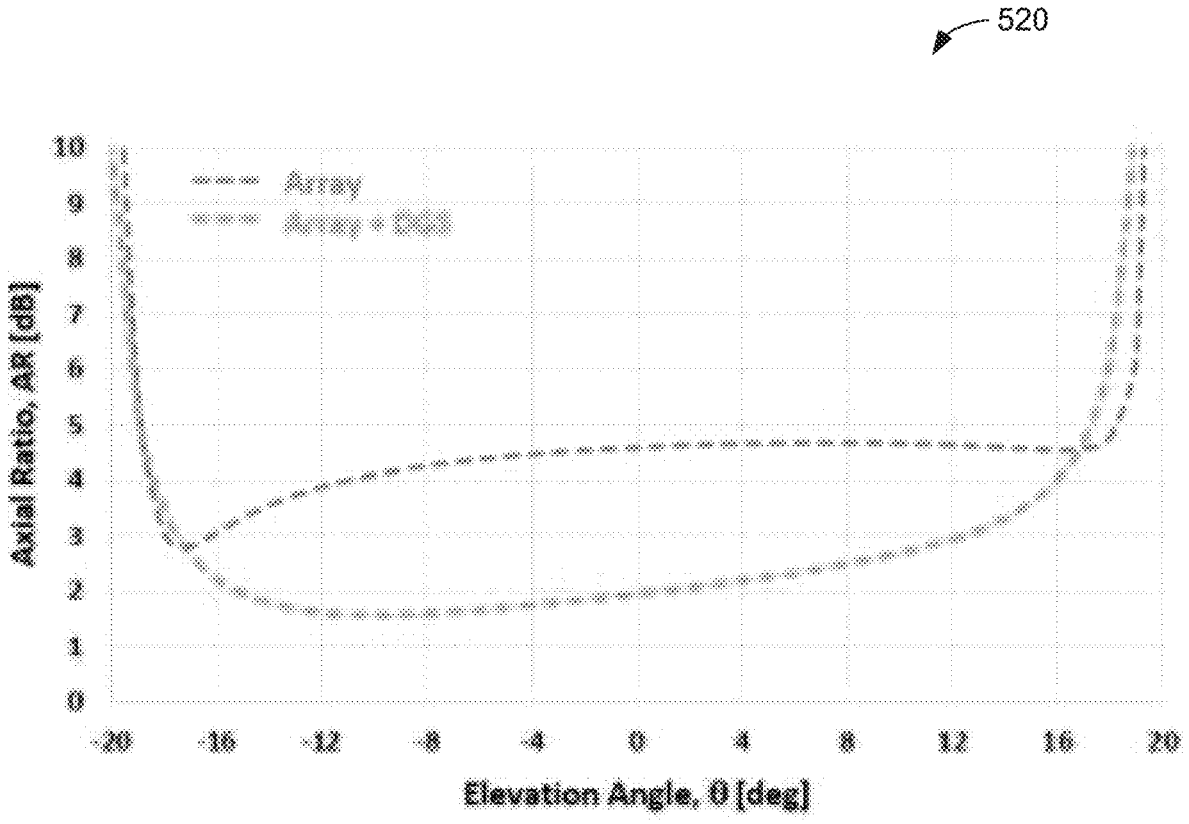

FIGS. 5A, 5B, and 5C depict example results of the example antenna 300 of FIG. 3. The results illustrated in FIGS. 5A, 5B, and 5C were developed using a finite element method (FEM) solver to predict performance. In the illustrated example of FIG. 5A, an example graph 500 illustrates example antenna gain measurements for the antenna 300 (Array+Defective Ground Structures (DGS)) and for an example antenna without ground plane discontinuities (Array). In the illustrated example of FIG. 5A, the antenna gain measurements describe the ability of the antennas to radiate power. In the illustrated example of FIG. 5A, the gain measurements for the antenna 300 (Array+DGS) and the antenna without ground plane discontinuities (Array) were measured at a first cross-section (0 degrees) as well as at a second cross-section perpendicular to the first-cross section (90 degrees). The graph 500 of FIG. 5A illustrates that the gain for the antenna 300 with ground plane discontinuities remains consistent with the gain of the antenna without ground plane discontinuities at both cross-sections. In the illustrated example of FIG. 5A, the antenna 300 includes a gain measurement of about 16.7 decibels above an isotropic radiator (dBi), and the antenna without ground plane discontinuities includes a gain measurement of about 16.1 dBi for both cross sections.

In the illustrated example of FIG. 5B, an example graph 510 illustrates example voltage standing wave ratio (VSWR) measurements for the antenna 300 (Array+DGS) and for the antenna without ground plane discontinuities (Array). In the illustrated example of FIG. 5B, the VSWR measurement describes the impedance match for the antenna. In the illustrated example of FIG. 5B, a good impedance match includes little to no power from the power input is reflected back from the antenna (e.g., the power input is either radiated by the antenna or absorbed by the antenna). In some examples, a desirable VSWR measurement is between 2 and 1. The example graph 510 of FIG. 5B illustrates an increase in the 2:1 VSWR bandwidth measurement for the antenna 300 compared to the antenna without ground plane discontinuities. In the illustrated example of FIG. 5B, the antenna without ground plane discontinuities includes a 2:1 VSWR bandwidth of about 950 megahertz (MHz). In the illustrated example of FIG. 5B, the antenna 300 includes a 2:1 VSWR bandwidth of about 1050 MHz.

In the illustrated example of FIG. 5C, an example graph 520 illustrates the example axial ratio measurements for the antenna 300 (Array+DGS) and for the antenna without ground plane discontinuities (Array). In the illustrated example of FIG. 5C, the axial ratio measurement describes the polarization of an antenna. In some examples, an axial ratio of 0 decibels (dB) illustrates circular polarization. In some examples, an axial ratio of 3 dB or below illustrates near circular polarization. In some examples, near circular polarization allows for minimal power loss between antennas when antennas are tilted on either plane. In the illustrated example of FIG. 5C, near circular polarization is desirable, therefore a desirable axial ratio measurement is 3 dB and below. The graph 520 of FIG. 5C illustrates an increase in the axial ratio beamwidth measurement for the antenna 300 compared to the antenna without ground plane discontinuities. In the illustrated example of FIG. 5C, the antenna without ground plane discontinuities includes a 2:1 axial ratio beamwidth of about 0 degrees. In the illustrated example of FIG. 5C, the antenna 300 includes a 2:1 axial ratio beamwidth of about 29 degrees. In the illustrated example of FIG. 5C, the ground plane discontinuities of the antenna 300 of FIG. 3 significantly increased the axial ratio and the circular polarization of the antenna 300 relative to the antenna without ground plane discontinuities.

Figure 6:
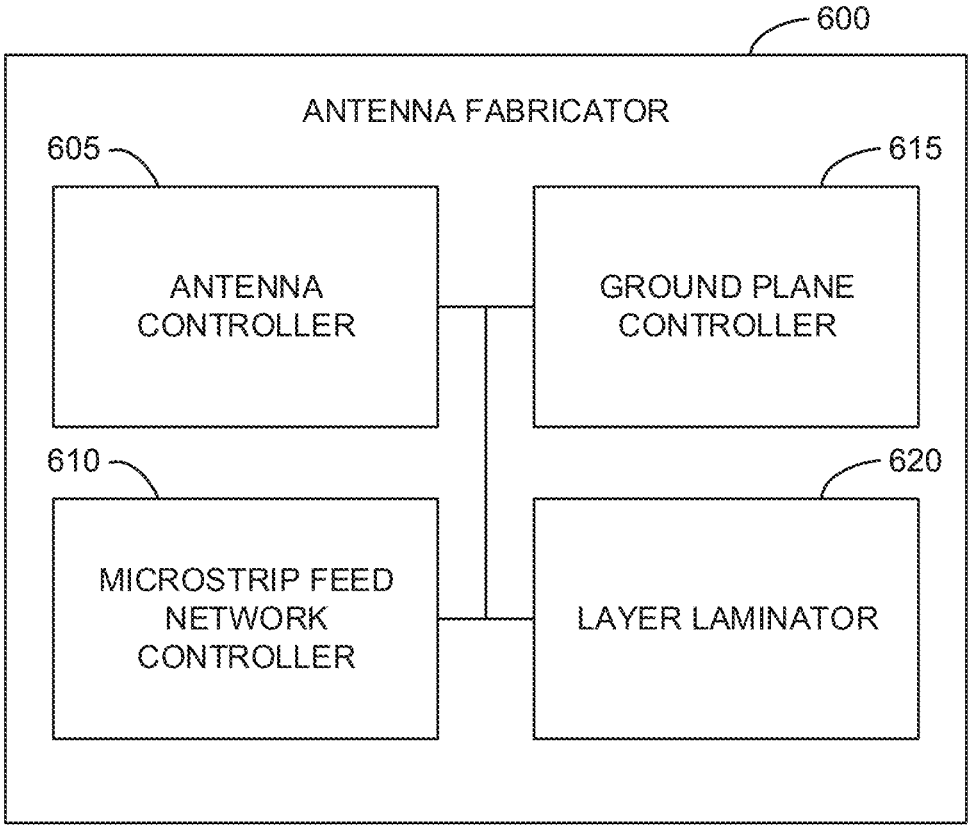
FIG. 6 is a block diagram of an example antenna fabricator to implement the examples disclosed herein.

FIG. 6 is a block diagram of an example antenna fabricator 600 to implement example antennas disclosed herein. In some examples, the antenna fabricator 600 is implemented to fabricate the example antenna 110 of FIG. 1, the example antenna 200 of FIGS. 2A, 2B, and/or the example antenna 300 of FIGS. 3, 4. In the illustrated example, the antenna fabricator 600 is assumed to implement the antenna 200 of FIGS. 2A, 2B. The antenna fabricator 600 includes an example antenna controller 605, an example microstrip feed network controller 610, an example ground plane controller 615, and an example layer laminator 620.

The antenna controller 605 fabricates the example antenna elements 230, 232, 234, 236 by disposing conductive material on the example dielectric layer. In some examples, the antenna controller 605 disposes copper on the dielectric layer 238. In some examples, the antenna controller 605 disposes conductive material on the dielectric layer 238 using additive methods such as, for example, printing, film deposition, etc. Additionally and/or alternatively, the antenna controller 605 fabricates the antenna elements 230, 232, 234, 236 by removing parts of a conductive material layer on the dielectric layer 238. For example, the antenna controller 605 can use subtractive methods such as, for example, laser etching, milling, wet etching, etc. to remove portions of a conductive material layer on the dielectric layer 238.

The example microstrip feed network controller 610 fabricates a microstrip feed network of the example microstrip feeds 250, 252, 254, 256. The microstrip feed network controller 610 disposes a conductive material on the example dielectric layer 258 to form the microstrip feeds 250, 252, 254, 256. In some examples, the microstrip feed network controller 610 disposes conductive material on the dielectric layer 258 using additive methods such as, for example, printing, film deposition, etc. Additionally and/or alternatively, the microstrip feed network controller 610 fabricates the microstrip feeds 250, 252, 254, 256 by removing parts of a conductive material layer on the dielectric layer 258. For example, the microstrip feed network controller 610 can use subtractive methods such as, for example, laser etching, milling, wet etching, etc. to remove portions of a conductive material layer on the dielectric layer 258.

The example ground plane controller 615 fabricates the example ground plane 262. The ground plane controller 615 disposes a conductive material on the dielectric layer 272 to form the ground plane 262. In some examples, the ground plane controller 615 disposes conductive material on the dielectric layer 272 using additive methods such as, for example, printing, film deposition, etc. Additionally and/or alternatively, the ground plane controller 615 fabricates the ground plane 262 by removing parts of a conductive material layer on the dielectric layer 272. For example, the ground plane controller 615 can use subtractive methods such as, for example, laser etching, milling, wet etching, etc. to remove portions of a conductive material layer on the dielectric layer 272. The ground plane controller 615 form discontinuities 264, 266, 268, 270 (e.g., gaps, openings, slots, etc.) within the ground plane 262. The ground plane controller 615 can use additive methods (e.g., printing, film deposition, etc.) or subtractive methods (e.g., laser etching, milling, wet etching, etc.) to form the discontinuities 264, 266, 268, 270 in the ground plane 262.

The layer laminator 620 fabricates the antenna 200 by mechanically coupling (laminating or bonding) the example antenna elements 230, 232, 234, 236, microstrip feeds 250, 252, 254, 256, and ground plane 262. The layer laminator 620 orients the example dielectric layer 238 for the antenna elements 230, 232, 234, 236 on the surface of the dielectric layer 258 for the microstrip feeds 250, 252, 254, 256. The layer laminator 620 includes an example first spacer layer between the dielectric layer 238 and the dielectric layer 258. In some examples, the first spacer layer is the example second layer 210 that includes the example dielectric layer 248. The layer laminator 620 orients the dielectric layer 258 on the surface of the dielectric layer 272 for the ground plane 262. The layer laminator 620 includes an example second spacer layer between the dielectric layer 258 and the dielectric layer 272. In some examples, the second spacer layer is the example fourth layer 220 that includes the example dielectric layer 260.

The layer laminator 620 laminates the dielectric layer 238, the dielectric layer 248, the dielectric layer 258, the dielectric layer 260, and the dielectric layer 272. In some examples, the dielectric layer 238, the dielectric layer 248, the dielectric layer 258, the dielectric layer 260, and the dielectric layer 272 are laminated using adhesive material. For example, each of the dielectric layer 238, the dielectric layer 248, the dielectric layer 258, the dielectric layer 260, and the dielectric layer 272 includes an adhesive material on the respective surfaces that face the surface to which the example antenna 200 is mounted. In such an example, the layer laminator 620 joins the dielectric layer 238, the dielectric layer 248, the dielectric layer 258, the dielectric layer 260, and the dielectric layer 272 using the adhesive materials between each layer. However, other methods for joining the dielectric layer 238, the dielectric layer 248, the dielectric layer 258, the dielectric layer 260, and the dielectric layer 272 may additionally and/or alternatively be used. For example, mechanical fasteners 250, 255 may be inserted through the dielectric layer 238, the dielectric layer 248, the dielectric layer 258, the dielectric layer 260, and the dielectric layer 272 to join them together.

While an example manner of implementing the example antenna fabricator 600 is illustrated in FIG. 6, one or more of the elements, processes and/or devices illustrated in FIG. 6 may be combined, divided, re-arranged, omitted, eliminated and/or implemented in any other way. Further, the example antenna controller 605, the example microstrip feed network controller 610, the example ground plane controller 615, the example layer laminator 620 and/or, more generally, the example antenna fabricator 600 of FIG. 6 may be implemented by hardware, software, firmware and/or any combination of hardware, software and/or firmware. Thus, for example, any of the example antenna controller 605, the example microstrip feed network controller 610, the example ground plane controller 615, the example layer laminator 620 and/or, more generally, the example antenna fabricator 600 could be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example antenna controller 605, the example microstrip feed network controller 610, the example ground plane controller 615 and/or the example layer laminator 620 is/are hereby expressly defined to include a non-transitory computer readable storage device or storage disk such as a memory, a digital versatile disk (DVD), a compact disk (CD), a Blu-ray disk, etc. including the software and/or firmware. Further still, the example antenna fabricator 600 of FIG. 6 may include one or more elements, processes and/or devices in addition to, or instead of, those illustrated in FIG. 6, and/or may include more than one of any or all of the illustrated elements, processes and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Figure 7:
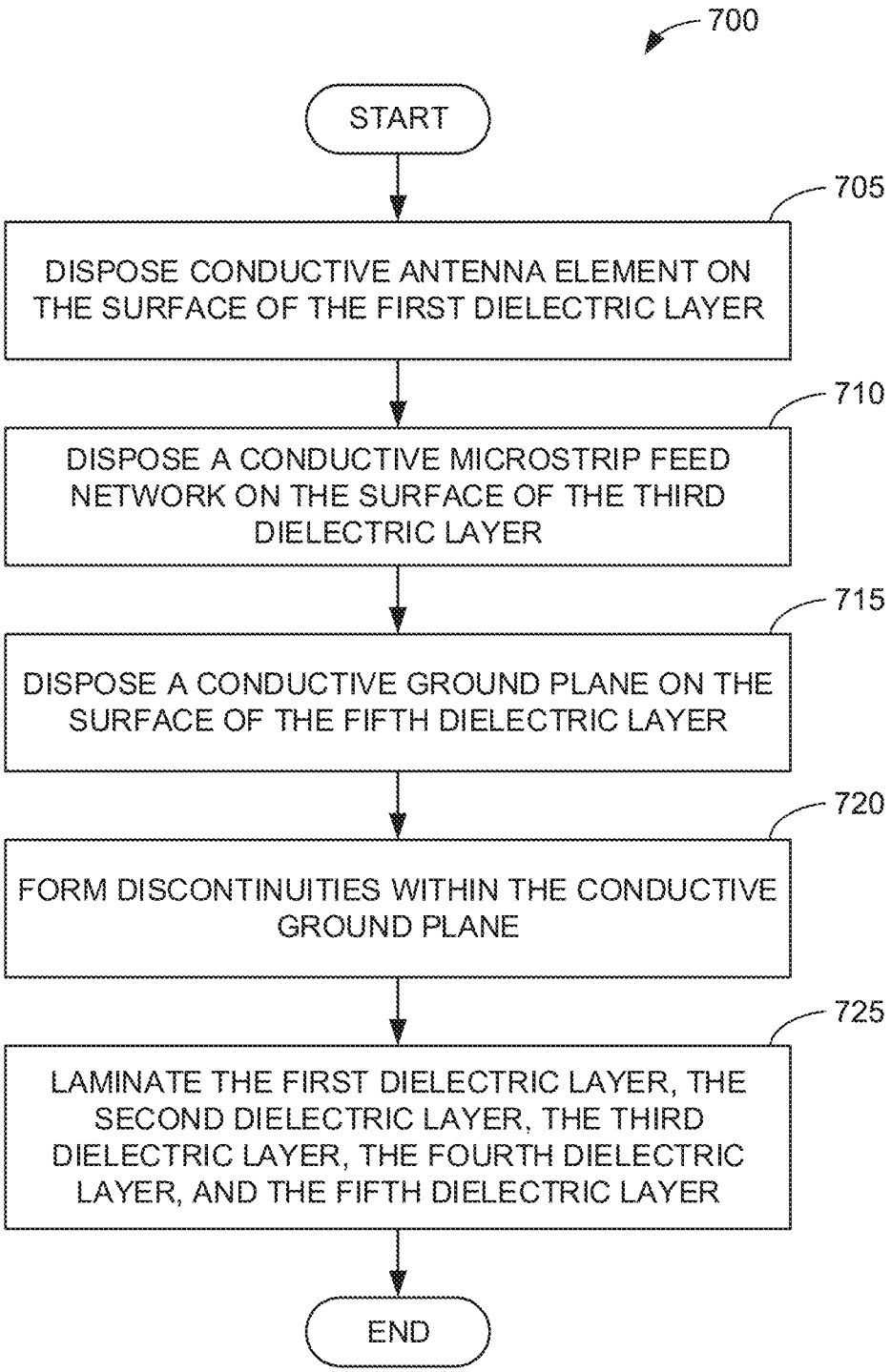
FIG. 7 is a flowchart representative of machine readable instructions which may be executed to implement the example antenna fabricator of FIG. 6.

A flowchart representative of example hardware logic, machine readable instructions, hardware implemented state machines, and/or any combination thereof for implementing the antenna fabricator 600 of FIG. 6 is shown in FIG. 7. The machine readable instructions may be one or more executable programs or portion(s) of an executable program for execution by a computer processor and/or processor circuitry, such as the processor 812 shown in the example processor platform 800 discussed below in connection with FIG. 8. The program may be embodied in software stored on a non-transitory computer readable storage medium such as a CD-ROM, a floppy disk, a hard drive, a DVD, a Blu-ray disk, or a memory associated with the processor 812, but the entire program and/or parts thereof could alternatively be executed by a device other than the processor 812 and/or embodied in firmware or dedicated hardware. Further, although the example program is described with reference to the flowchart illustrated in FIG. 7, many other methods of implementing the example antenna fabricator 600 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware. The processor circuitry may be distributed in different network locations and/or local to one or more devices (e.g., a multi-core processor in a single machine, multiple processors distributed across a server rack, etc).

The machine readable instructions described herein may be stored in one or more of a compressed format, an encrypted format, a fragmented format, a compiled format, an executable format, a packaged format, etc. Machine readable instructions as described herein may be stored as data or a data structure (e.g., portions of instructions, code, representations of code, etc.) that may be utilized to create, manufacture, and/or produce machine executable instructions. For example, the machine readable instructions may be fragmented and stored on one or more storage devices and/or computing devices (e.g., servers) located at the same or different locations of a network or collection of networks (e.g., in the cloud, in edge devices, etc.). The machine readable instructions may require one or more of installation, modification, adaptation, updating, combining, supplementing, configuring, decryption, decompression, unpacking, distribution, reassignment, compilation, etc. in order to make them directly readable, interpretable, and/or executable by a computing device and/or other machine. For example, the machine readable instructions may be stored in multiple parts, which are individually compressed, encrypted, and stored on separate computing devices, wherein the parts when decrypted, decompressed, and combined form a set of executable instructions that implement one or more functions that may together form a program such as that described herein.

In another example, the machine readable instructions may be stored in a state in which they may be read by processor circuitry, but require addition of a library (e.g., a dynamic link library (DLL)), a software development kit (SDK), an application programming interface (API), etc. in order to execute the instructions on a particular computing device or other device. In another example, the machine readable instructions may need to be configured (e.g., settings stored, data input, network addresses recorded, etc.) before the machine readable instructions and/or the corresponding program(s) can be executed in whole or in part. Thus, machine readable media, as used herein, may include machine readable instructions and/or program(s) regardless of the particular format or state of the machine readable instructions and/or program(s) when stored or otherwise at rest or in transit.

The machine readable instructions described herein can be represented by any past, present, or future instruction language, scripting language, programming language, etc. For example, the machine readable instructions may be represented using any of the following languages: C, C++, Java, C #, Perl, Python, JavaScript, HyperText Markup Language (HTML), Structured Query Language (SQL), Swift, etc.

As mentioned above, the example processes of FIG. 7 may be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

FIG. 7 is a flowchart representative of an example method 700 to implement examples disclosed herein. In some examples, the method 700 implements the example antenna 110 of FIG. 1, the example antenna 200 of FIGS. 2A, 2B, and/or the example antenna 300 of FIGS. 3, 4. In the illustrated example, the method 700 is assumed to implement the antenna 200 of FIGS. 2A, 2B. The method 700 of FIG. 7 begins at block 705 at which the example antenna controller 605 disposes a conductive antenna element on the surface of the first dielectric layer. In the illustrated example, the conductive antenna element includes the example antenna elements 230, 232, 234, 236. In some examples, the antenna controller 605 disposes conductive material on a first dielectric layer to form the antenna element. In the illustrated example, the first dielectric layer includes the example dielectric layer 238. In some examples, the antenna controller 605 disposes copper as the conductive material on the first dielectric layer. However, other conductive materials may additionally and/or alternatively be used.

At block 710, the example microstrip feed network controller 610 disposes a conductive microstrip feed network on the surface of the third dielectric layer. In the illustrated example, the conductive microstrip feed network includes the example microstrip feeds 250, 252, 254, 256, and the third dielectric layer includes the example dielectric layer 258. The microstrip feed network controller 610 disposes a conductive material on the third dielectric layer (e.g., similar to the dielectric layer 258 of FIG. 2A) to form the microstrip feed network. In some examples, the microstrip feed network controller 610 disposes copper as the conductive material on the third dielectric layer. However, other conductive materials may additionally and/or alternatively be used.

At block 715, the example ground plane controller 615 disposes the conductive ground plane on the surface of the fifth dielectric layer. In the illustrated example, the conductive ground plane includes the example ground plane 262, and the fifth dielectric layer includes the dielectric layer 272. The ground plane controller 615 disposes a conductive material on a fifth dielectric layer (e.g., similar to the dielectric layer 272 of FIG. 2A) to form the ground plane (e.g., similar to the ground plane 262 of FIG. 2A). In some examples, the ground plane controller 615 disposes copper as the conductive material on the fifth dielectric layer. However, other conductive materials may additionally and/or alternatively be used.

At block 720, the ground plane controller 615 forms discontinuities within the conductive ground plane 262. In some examples, the discontinuities include the example discontinuities 264, 266, 268, 270. In some examples, the ground plane controller 615 disposes a gap or hole in the conductive material of the ground plane 262. In some examples, the ground plane controller 615 disposes discontinuities (e.g., similar to the discontinuities 264, 266, 268, 270 of FIG. 2A) that are regularly spaced throughout the ground plane (e.g., similar to the ground plane 262 of FIG. 2A) on the fifth dielectric layer (e.g., similar to the dielectric layer 272 of FIG. 2A).

At block 725, the example layer laminator 620 laminates the first dielectric layer, the second dielectric layer, the third dielectric layer, the fourth dielectric layer, and the fifth dielectric layer. In some examples, the first dielectric layer is the dielectric layer 238, the second dielectric layer is the example dielectric layer 248, the third dielectric layer is the dielectric layer 258, the fourth dielectric layer is the example dielectric layer 260, and the fifth dielectric layer is the dielectric layer 272. The layer laminator 620 orients the first dielectric layer (e.g., similar to the dielectric layer 238 of FIG. 2A) on the conductive microstrip feed network surface of the third dielectric layer (e.g., similar to the dielectric layer 258 of FIG. 2A). The layer laminator 620 includes the second dielectric layer (e.g., similar to the dielectric layer 248 of FIG. 2A) between the first dielectric layer and the conductive microstrip feed network on the surface of the third dielectric layer. The layer laminator 620 orients the third dielectric layer on the conductive ground plane surface of the fifth dielectric (e.g., similar to the dielectric layer 272 of FIG. 2A). The layer laminator 620 includes an example fourth dielectric layer (e.g., similar to the dielectric layer 260 of FIG. 2A) between the third dielectric layer and the conductive ground plane on the surface of the fifth dielectric layer. In some examples, the first dielectric layer, the second dielectric layer, the third dielectric layer, the fourth dielectric layer, and the fifth dielectric layer are laminated using adhesive material. In such an example, the layer laminator 620 joins the first dielectric layer, the second dielectric layer, the third dielectric layer, the fourth dielectric layer, and the fifth dielectric layer using the adhesive materials between each layer. In some examples, the first dielectric layer, the second dielectric layer, the third dielectric layer, the fourth dielectric layer, and the fifth dielectric layer are joined using mechanical fasteners (e.g., screws, bolts, rivets, etc.). For example, the layer laminator 620 inserts a screw through the first dielectric layer, the second dielectric layer, the third dielectric layer, the fourth dielectric layer, and the fifth dielectric. After block 725, the process 700 ends.

Figure 8:
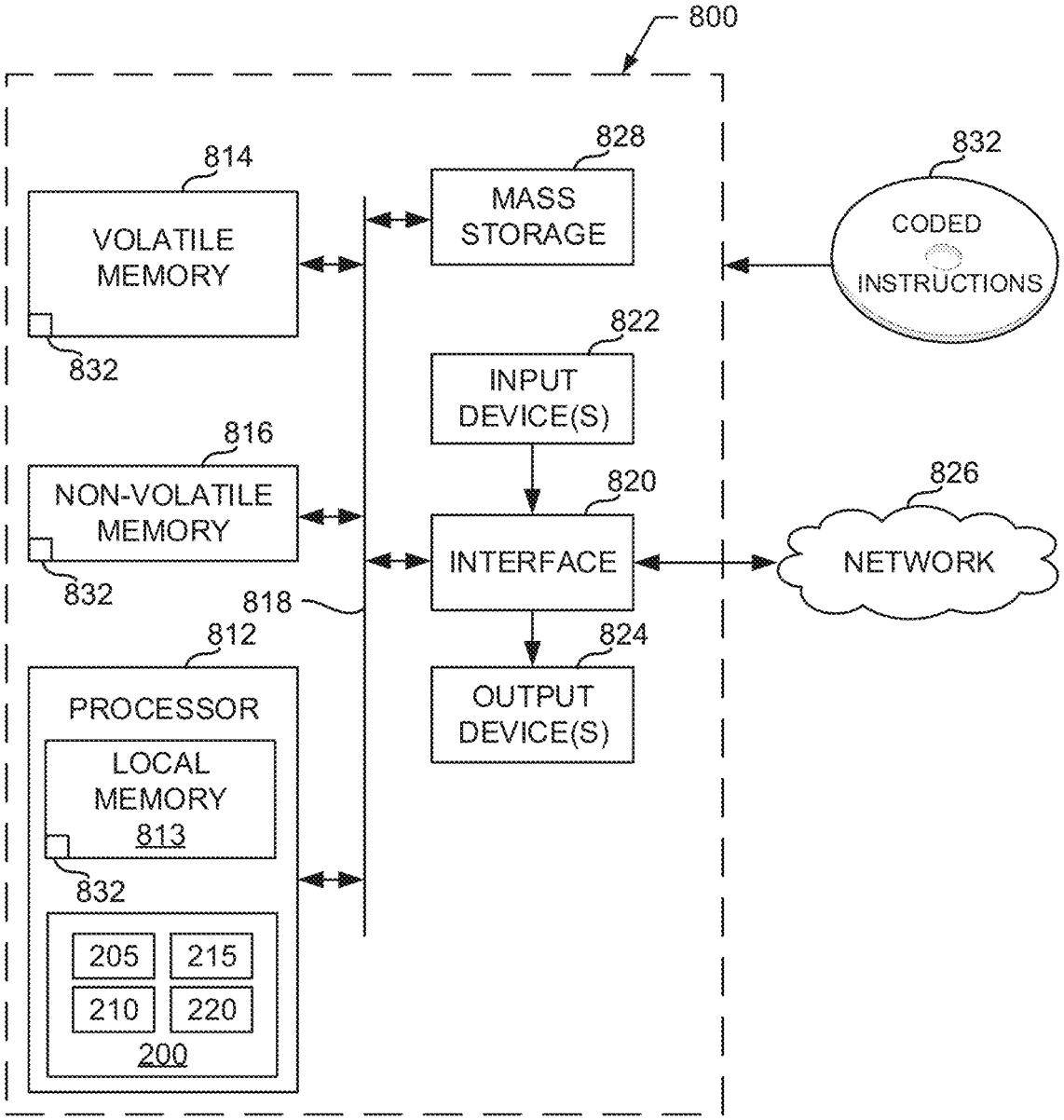
FIG. 8 is a block diagram of an example processing platform structured to execute the instructions of FIG. 7 to implement the example antenna fabricator of FIG. 6.

FIG. 8 is a block diagram of an example processor platform 800 structured to execute the instructions of FIG. 7 to implement the antenna fabricator 600 of FIG. 6. The processor platform 800 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, or any other type of computing device.

The processor platform 800 of the illustrated example includes a processor 812. The processor 812 of the illustrated example is hardware. For example, the processor 812 can be implemented by one or more integrated circuits, logic circuits, microprocessors, GPUs, DSPs, or controllers from any desired family or manufacturer. The hardware processor may be a semiconductor based (e.g., silicon based) device. In this example, the processor implements antenna controller 605, the example microstrip feed network controller 610, the example ground plane controller 615, and the example layer laminator 620.

The processor 812 of the illustrated example includes a local memory 813 (e.g., a cache). The processor 812 of the illustrated example is in communication with a main memory including a volatile memory 814 and a non-volatile memory 816 via a bus 818. The volatile memory 814 may be implemented by Synchronous Dynamic Random Access Memory (SDRAM), Dynamic Random Access Memory (DRAM), RAMBUS® Dynamic Random Access Memory (RDRAM®) and/or any other type of random access memory device. The non-volatile memory 816 may be implemented by flash memory and/or any other desired type of memory device. Access to the main memory 814, 816 is controlled by a memory controller.

The processor platform 800 of the illustrated example also includes an interface circuit 820. The interface circuit 820 may be implemented by any type of interface standard, such as an Ethernet interface, a universal serial bus (USB), a Bluetooth® interface, a near field communication (NFC) interface, and/or a PCI express interface.

In the illustrated example, one or more input devices 822 are connected to the interface circuit 820. The input device(s) 822 permit(s) a user to enter data and/or commands into the processor 812. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 824 are also connected to the interface circuit 820 of the illustrated example. The output devices 824 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer and/or speaker. The interface circuit 820 of the illustrated example, thus, typically includes a graphics driver card, a graphics driver chip and/or a graphics driver processor.

The interface circuit 820 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 826. The communication can be via, for example, an Ethernet connection, a digital subscriber line (DSL) connection, a telephone line connection, a coaxial cable system, a satellite system, a line-of-site wireless system, a cellular telephone system, etc.

The processor platform 800 of the illustrated example also includes one or more mass storage devices 828 for storing software and/or data. Examples of such mass storage devices 828 include floppy disk drives, hard drive disks, compact disk drives, Blu-ray disk drives, redundant array of independent disks (RAID) systems, and digital versatile disk (DVD) drives.

The machine executable instructions 832 of FIG. 7 may be stored in the mass storage device 828, in the volatile memory 814, in the non-volatile memory 816, and/or on a removable non-transitory computer readable storage medium such as a CD or DVD.

From the foregoing, it will be appreciated that example methods, apparatus and articles of manufacture have been disclosed that enable a flexible, lightweight antenna for conformal surfaces (e.g., surfaces that easily fit with the mounting surface of the antenna) and non-conformal surfaces (e.g., surfaces that do not easily fit with the mounting surface of the antenna). The disclosed methods, apparatus and articles of manufacture allow for an antenna to be lightweight with low aerodynamic drag and low visibility for aerial vehicles with conformal and nonconformal surfaces. The disclosed methods, apparatus and articles of manufacture reduce electrical interference for the antenna from the surfaces of the aerial vehicle.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

Example methods, apparatus, systems, and articles of manufacture for an electromagnetic radiator with ground planes having discontinuities are disclosed herein. Further examples and combinations thereof include the following:

Example 1 includes an antenna comprising an antenna element, including a first conductive material adjacent to a first dielectric material, to transmit a signal, a microstrip feed network, including a second conductive material adjacent to a second dielectric material, to transmit power to the antenna element, the antenna element proximity coupled to the microstrip feed network, and a ground plane, including a third conductive material adjacent to a third dielectric material, to provide a signal return path, the ground plane including gaps regularly spaced in the third conductive material.

Example 2 includes the antenna of example 1, wherein the antenna element is on an outer surface of the antenna, the antenna element electrically coupled to the microstrip feed network.

Example 3 includes the antenna of example 1, wherein the microstrip feed network is electrically coupled to the ground plane, and wherein the ground plane is on a bottom surface of the antenna.

Example 4 includes the antenna of example 1, wherein the first conductive material, the second conductive material, and the third conductive material include copper.

Example 5 includes the antenna of example 1, wherein the antenna element and the microstrip feed network are separated by a first spacer layer, the first spacer layer including a fourth dielectric material.

Example 6 includes the antenna of example 1, wherein the microstrip feed network and the ground plane are separated by a second spacer layer, the second spacer layer including a fifth dielectric material.

Example 7 includes an apparatus to form an antenna, the apparatus comprising a first layer to transit a signal, the first layer including a first conductive material on a surface of a first dielectric, a second layer to transmit power to the first layer, the second layer including a second conductive material on a surface of a second dielectric material, and a third layer to provide a signal return path, the third layer including a third conductive material on a surface of a third dielectric material, the third layer including regularly-spaced gaps in the third conductive material on the surface of the third dielectric material.

Example 8 includes the apparatus of example 7, wherein the first layer includes an antenna element.

Example 9 includes the apparatus of example 7, wherein the second layer includes a microstrip feed network.

Example 10 includes the apparatus of example 7, wherein the third layer includes a ground plane.

Example 11 includes the apparatus of example 7, wherein the first conductive material, the second conductive material, and the third conductive material include copper.

Example 12 includes the apparatus of example 7, wherein the first layer and the second layer are separated by a fourth layer, the fourth layer including a fourth dielectric material.

Example 13 includes the apparatus of example 12, wherein the second layer and the third layer are separated by a fifth layer, the fifth layer including a fifth dielectric material.

Example 14 includes the apparatus of example 13, wherein the first layer, the second layer, the third layer, the fourth layer, and the fifth layer are joined using an adhesive material.

Example 15 includes the apparatus of example 13, wherein the first layer, the second layer, the third layer, the fourth layer, and the fifth layer are joined using mechanical fasteners.

Example 16 includes a method of forming an antenna, the method comprising disposing a first conductive element on a surface of a first dielectric material to form a first layer, disposing a second conductive element on a surface of a second dielectric material to form a second layer, disposing a third conductive element on a surface of a third dielectric material to form a third layer, the third conductive element being a ground plane, disposing regularly-spaced gaps in the third conductive element, and laminating the first layer, the second layer, the third layer, a fourth layer of a fourth dielectric material, and a fifth layer of a fifth dielectric material to form the antenna, wherein the fourth layer is between the first layer and the second layer, and wherein the fifth layer is between the second layer and the third layer.

Example 17 includes the method of example 16, wherein the first layer includes an antenna element to transmit a signal.

Example 18 includes the method of example 16, wherein the second layer includes a microstrip feed network to transmit power to an antenna element.

Example 19 includes the method of example 16, wherein each of the surface of the first dielectric material, the surface of the second dielectric material, and the surface of the third dielectric material faces a same direction.

Example 20 includes the method of example 16, wherein the first conductive element, the second conductive element, and the third conductive element include copper.

The following claims are hereby incorporated into this Detailed Description by this reference, with each claim standing on its own as a separate embodiment of the present disclosure.

What is claimed is:

1. An antenna comprising:

antenna elements, each including a first conductive material adjacent to a first dielectric material, to transmit a signal;

microstrip feeds, each including a second conductive material adjacent to a second dielectric material, to transmit power to the antenna elements, each antenna element proximity coupled to a respective one of the microstrip feeds; and a ground plane, including a third conductive material adjacent to a third dielectric material, to provide a signal return path, the ground plane including gaps regularly spaced in the third conductive material, the entirety of each gap spaced away from peripheral edges of the ground plane and each of the gaps corresponding to a respective one of the antenna elements and structured to affect operation of the respective antenna element.

2. The antenna of claim 1, wherein the antenna elements are on an outer surface of the antenna, the antenna elements electrically coupled to the microstrip feeds.

3. The antenna of claim 1, wherein the microstrip feeds are electrically coupled to the ground plane, and wherein the ground plane is on a bottom surface of the antenna.

4. The antenna of claim 1, wherein the first conductive material, the second conductive material, and the third conductive material include copper.

5. The antenna of claim 1, wherein the antenna elements and the microstrip feeds are separated by a first spacer layer, the first spacer layer including a fourth dielectric material.

6. The antenna of claim 1, wherein the microstrip feeds and the ground plane are separated by a second spacer layer, the second spacer layer including a fifth dielectric material.

7. The antenna of claim 1, wherein each of the gaps is immediately adjacent to the respective ones of the antenna elements.

8. The antenna of claim 1, wherein each of the gaps is spaced within edges of the respective ones of the antenna elements.

9. The antenna of claim 1, wherein each of the gaps is orientated in a same direction as the respective ones of the antenna elements.

10. The antenna of claim 9, wherein each of the gaps is orientated in a diagonal direction relative to the peripheral edges.

11. An apparatus to form an antenna, the apparatus comprising:

a first layer to transit a signal, the first layer including a first conductive material on a surface of a first dielectric;

a second layer to transmit power to the first layer, the second layer including a second conductive material on a surface of a second dielectric material; and a third layer to provide a signal return path, the third layer including a third conductive material on a surface of a third dielectric material, the third layer including regularly-spaced gaps in the third conductive material on the surface of the third dielectric material, the entirety of each gap spaced away from peripheral edges of the third layer and each of the gaps corresponding to the first layer and structured to affect operation of the first layer.

12. The apparatus of claim 11, wherein the first layer includes antenna elements.

13. The apparatus of claim 11, wherein the second layer includes microstrip feeds.

14. The apparatus of claim 11, wherein the third layer includes a ground plane.

15. The apparatus of claim 11, wherein the first conductive material, the second conductive material, and the third conductive material include copper.

16. The apparatus of claim 11, wherein the first layer and the second layer are separated by a fourth layer, the fourth layer including a fourth dielectric material.

17. The apparatus of claim 16, wherein the second layer and the third layer are separated by a fifth layer, the fifth layer including a fifth dielectric material.

18. The apparatus of claim 17, wherein the first layer, the second layer, the third layer, the fourth layer, and the fifth layer are joined using an adhesive material.

19. The apparatus of claim 17, wherein the first layer, the second layer, the third layer, the fourth layer, and the fifth layer are joined using mechanical fasteners.

20. A method of forming an antenna, the method comprising:

disposing first conductive elements on a surface of a first dielectric material to form a first layer;

disposing second conductive elements on a surface of a second dielectric material to form a second layer;

disposing a third conductive element on a surface of a third dielectric material to form a third layer, the third conductive element being a ground plane;

disposing regularly-spaced gaps in the third conductive element, the entirety of each gap spaced away from peripheral edges of the ground plane and each of the gaps corresponding to a respective one of the first conductive elements and structured to affect operation of the respective one of the first conductive elements; and laminating the first layer, the second layer, the third layer, a fourth layer of a fourth dielectric material, and a fifth layer of a fifth dielectric material to form the antenna, wherein the fourth layer is between the first layer and the second layer, and wherein the fifth layer is between the second layer and the third layer.

21. The method of claim 20, wherein the first layer includes antenna elements to transmit a signal.

22. The method of claim 20, wherein the second layer includes microstrip feeds to transmit power to antenna elements.

23. The method of claim 20, wherein each of the surface of the first dielectric material, the surface of the second dielectric material, and the surface of the third dielectric material faces a same direction.

24. The method of claim 20, wherein the first conductive elements, the second conductive elements, and the third conductive element include copper.

* * * * *